United States Patent [19]

Guzorek

[11] Patent Number: 4,750,433

[45] Date of Patent: Jun. 14, 1988

[54] IN-LINE POWER VENTER

[75] Inventor: Steven E. Guzorek, Kinston, N.C.

[73] Assignee: The Field Controls Company, Kinston, N.C.

[21] Appl. No.: 76,474

[22] Filed: Jul. 22, 1987

[51] Int. Cl.[4] ..... F23L 17/00

[52] U.S. Cl. ..... 110/162; 126/292; 126/307 R

[58] Field of Search ..... 110/162, 163, 159; 126/307 R, 292

[56] References Cited

U.S. PATENT DOCUMENTS

| | | | |
|---|---|---|---|
| 886,268 | 4/1908 | Stuart . | |
| 1,297,871 | 3/1919 | Lamb | 110/162 |
| 2,300,578 | 11/1942 | Lane | 110/162 |
| 2,588,012 | 3/1952 | Kirkpatrick | 248/18 |
| 2,617,371 | 11/1952 | Resek et al. | 110/162 |

OTHER PUBLICATIONS

Three literature pages of Tjernlund Products Inc. of an unknown date but in existence prior to Jul. 22, 1986.

A brochure of The Field Controls Company published Aug. 1985.

*Primary Examiner*—Edward G. Favors

*Attorney, Agent, or Firm*—Wood, Dalton, Phillips, Mason & Rowe

[57] ABSTRACT

An in-line power venter insertable into a vent pipe and having a housing attachable to the vent pipe. The housing has separate negative and positive pressure chambers provided by a separator plate positioned within the housing and having an opening for flow of gas to a blower wheel in the positive pressure chamber. The separator plate has a pair of generally semicircular, oppositely-extending sections disposed above the housing for insertion into the vent pipe to positively separate negative and positive pressure zones within the vent pipe. A flow-regulating plate for draft control is mounted within the housing and is manually-adjustable externally of the housing for movement toward and away from an opening in the separator plate to control the flow rate through the opening to the central area of the blower wheel.

10 Claims, 1 Drawing Sheet

FIG. 1
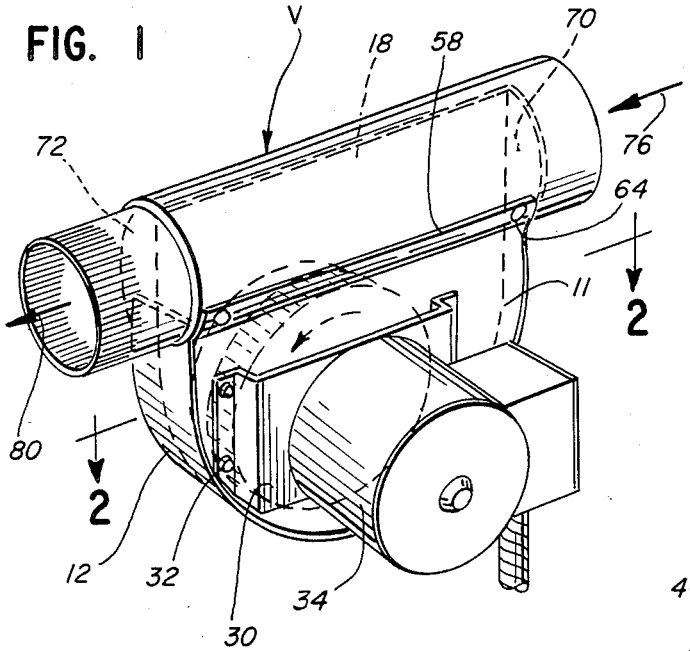
FIG. 2
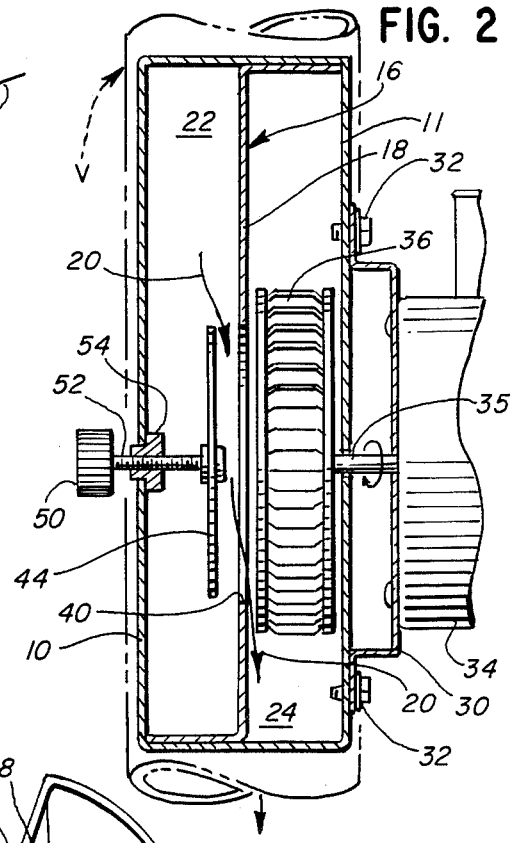
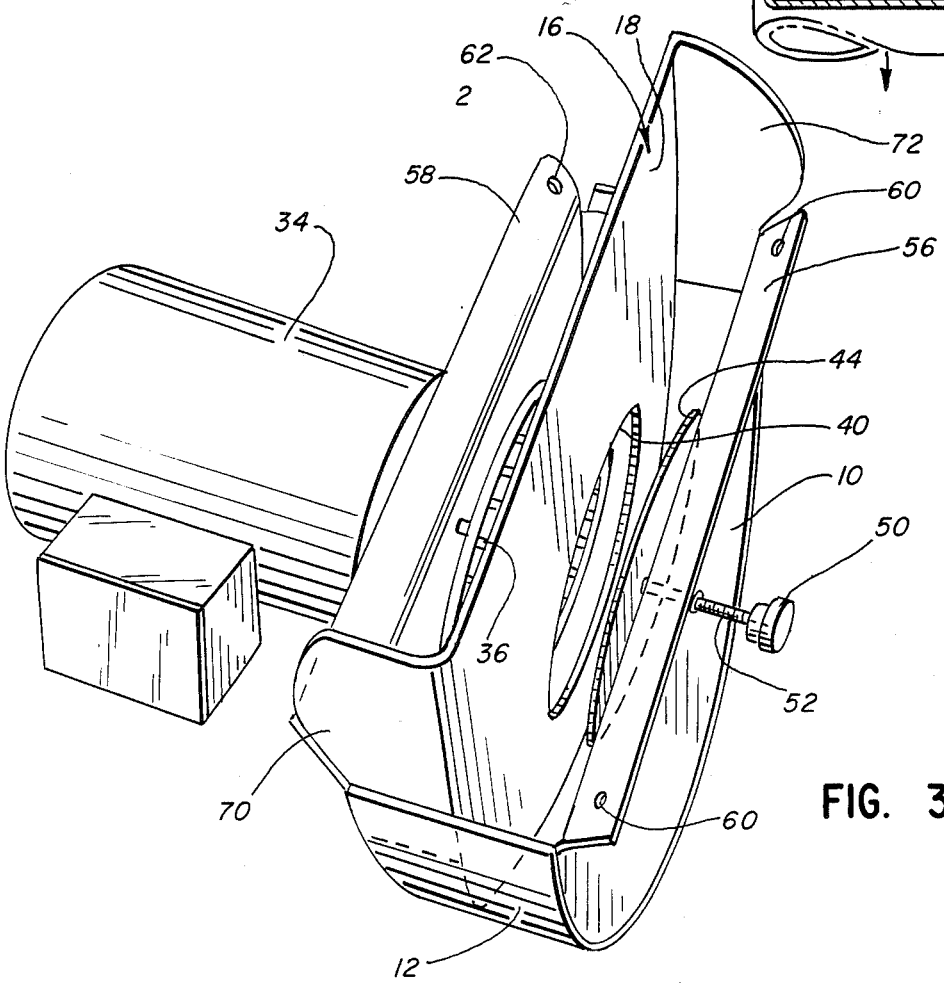
FIG. 3

IN-LINE POWER VENTER

DESCRIPTION

1. Field of the Invention

This invention relates to an in-line power venter insertable into a vent pipe for establishing a draft for flow of combustion gas from a fuel-burning appliance and which may be easily inserted into an installed vent pipe and which has structure for separating the vent pipe into positive and negative pressure sections and externally-operable means for regulating the flow through the vent pipe.

2. Background of the Invention

Devices for overcoming draft problems frequently associated with chimneys as well as vent systems having a motor-driven fan or other gas-propelling device are well known in the art and are classified as draft inducers. Also known in the art are power venters having a motor-driven, centrifugal fan wheel in a housing that can be mounted in association with a vent pipe to create a mechanical draft, as may be required by new high-efficiency furnaces, unit heaters, and other fuel-burning appliances. The power venter assures a constant, uninterrupted flow of draft and flue gases through the fuel-burning appliance and its vent system. Both draft inducers and power venters have in common a housing and a motor-driven fan or blower wheel.

An early example of a fan connectable into a flue pipe is shown in U.S. Pat. No. 886,268 wherein the fan is manually-driven.

The assignee of this application markets a draft inducer having a housing attachable to an opening in a vent pipe and with a motor-driven radial-type fan wheel exposed to the gas flow in the vent pipe to augment the drafting/venting capabilities of the vent system. Applicant's assignee also markets a power venter having a housing mounting a motor-driven centrifugal fan wheel, with the mounting of the housing requiring a 90° elbow because of gas flow departing the housing at a right angle to the gas flow into the housing.

Other known prior art draft devices which may be mounted in-line in a vent pipe of a vent system comprises the Kirkpatrick U.S. Pat. No. 2,588,012 and the Resek et al. U.S. Pat. No. 2,617,371.

Applicant's in-line power venter provides for installation thereof in a previously-installed vent pipe by merely cutting an opening of the required size therein, provides for positive flow of draft and flue gases through the fuel-burning appliance and its vent system, and provides for easy draft adjustment.

SUMMARY OF THE INVENTION

A primary feature of the invention is to provide an in-line power venter which can be attached to a vent pipe and exposed to the interior of the vent pipe by an opening cut in the vent pipe and which has means for establishing separated positive and negative pressure areas whereby there is a highly efficient flow of draft and flue gases through the vent pipe.

Although it is old to mount a housing to a vent pipe and expose a gas-propelling fan to the interior of the vent pipe through an opening therein, such prior structure has not provided for the most efficient operation, since there is a tendency to get recirculation of the gases and stratification. The in-line power venter disclosed herein provides for the use of a separator plate to provide positive and negative pressue chambers within the housing and completely isolate positive and negative pressure area within the vent pipe. This positive separation enables the creation of more static pressure by the blower mounted in the housing and assures positive outflow of the draft and flue gases as the negative pressure increases.

In view of the foregoing, it is a primary object of the invention to provide an in-line power venter positionable within an opening of a vent pipe and which creates positive pressure zones within the housing of the power venter as well as separated positive and negative pressure zones within the vent pipe to avoid recirculation of the gases in the vent pipe and to assure positive outflow of the gases.

Still another object of the invention is to provide an in-line power venter having means for controlling the flow therethrough to achieve the desired draft and which embodies a flow-regulating plate within the housing of the power venter movable relative to an opening in a separator plate in the housing which directs air to the central area of a blower wheel. The flow-regulating plate is externally adjustable and structure precludes complete closing of said opening.

DESCRIPTION OF THE DRAWINGS

FIG. 1 is a perspective view, looking toward the rear of the in-line power venter as installed in a length of vent pipe;

FIG. 2 is a plan section, taken generally along the line 2—2 in FIG. 1 on an enlarged scale and showing the vent pipe in broken line; and FIG. 3 is a perspective view of the in-line power venter, looking toward the top front thereof.

DESCRIPTION OF THE PREFERRED EMBODIMENT

The in-line power venter is shown installed in a vent pipe in FIGS. 1 and 2 and is shown as a manufactured unit in FIG. 3.

The in-line power venter has a housing, open at the top, which has a front wall 10, a rear wall 11, and a generally semicircular, curved connecting wall 12 which connects with the front and rear walls to form an enclosure with an open top.

A separator plate, indicated generally at 16 is positioned within the housing. The separator plate has a planar section 18, mounted in parallel, generally equidistant relation with the front and rear walls and having a curved periphery fitted to the interior of the curved connecting wall 12 to define a pair of separated chambers within the housing. With the gas flow through the housing in the direction indicated by the arrows 20 in FIG. 2, a first chamber 22 is a negative pressure chamber and a second chamber 24 is a positive pressure chamber.

The rear wall 11 of the housing has a support plate 30 attached thereto by fasteners 32 which mounts a motor 34 having a drive shaft 35 extending through an opening in the rear wall 11 into the positive pressure chamber and mounting a centrifugal blower wheel 36.

The planar section 18 of the separator plate 16 has an opening 40 for gas flow from the negative pressure chamber 22 to the central area of the centrifugal blower wheel 36 which creates a positive pressure in the positive pressure chamber 24.

A flow-regulating plate, in the form of a generally circular disc 44, is mounted in the negative pressure chamber 22 for movement toward and away from the opening 40 to control the flow rate to the blower wheel 36 and, thus, control the draft. This flow-regulating plate is adjustable externally of the housing by means of a knob 50 fixed to a threaded shaft 52, which is threaded into a nut 54 mounted in the front wall of the housing and with an end of the threaded member 52 mounting the flow-regulating plate 44. The length of the threaded member 52 is set whereby the knob will engage the outer surface of the nut 54, with the flow-regulating plate 44 still at a short distance from the opening 40 whereby the opening cannot be closed.

The housing is mountable to a vent pipe, as indicated at V, in FIGS. 1 and 2 by means of upwardly-extending flanges 56 and 58, respectively, at the upper edges of the front and rear walls and which are also angled outwardly to generally correspond to the contour of the vent pipe and with the flanges having openings 60 and 62 at their ends to receive attaching members 64 which thread into the vent pipe.

In order to assure against recirculation of gases in the vent pipe when the in-line power venter is installed within an opening in the vent pipe, the separator plate 16 has structure to fit into the vent pipe and separate the negative and positive pressure zones within the vent pipe from each other. This means comprises a pair of generally semicircular plate sections 70 and 72 above and extending from the planar section 18 of the separator plate in opposite directions and at generally right angles thereto and each having a curved contour corresponding to the curvature of the vent pipe. As seen in FIG. 1, the generally semicircular plate section 70 obstructs approximately one-half of the vent pipe V whereby gases flowing in the direction of the arrow 76 are caused to flow rearwardly of the separator plate, as seen in FIG. 1, whereby the gases will enter the negative pressure chamber 22. These gases cannot flow directly through the vent pipe since the generally semicircular plate section 72 is positioned to block continuing flow and require that the flow be through the opening 40 in the separator plate to the blower wheel. Similarly, the generally semicircular plate sections 70 and 72 function to assure that the positive pressure zone is separated from the negative pressure zone and the vent pipe upstream of the power venter because of the generally semicircular plate section 70 extending forwardly and the generally semicircular plate section 72 extending rearwardly, as seen in FIG. 1, whereby gases leaving the positive pressure chamber 24 can only flow in the direction of the arrow 80. The negative pressure chamber 22 of the housing aligns with that part of the vent pipe V which is disposed rearwardly of the separator plate 18, as seen in FIG. 1, and the positive pressure chamber 24 aligns with that part of the vent pipe which is forwardly of the separator plate.

In installing the in-line power venter, the opening in the vent pipe need be substantially no greater than the dimension of the open top of the housing, with the power venter being slightly cocked to first insert one of the generally semicircular plate sections into the vent pipe and then changed to a different angle to insert the second of the generally semicircular plate sections and, thereafter, the upwardly-extending flanges 56 and 58 can be attached to the vent pipe. In an alternate construction, the generally semicircular plate section 70 can extend upwardly at an angle toward the other plate section to assist in directing the air flow from the centrifugal blower wheel 36.

I claim:

1. An in-line power venter comprising, a blower housing having a wall structure attachable to a vent pipe for a fuel burning device and including spaced-apart front and rear walls, a motor mounted on one of said front and rear walls and having a drive shaft extending into said blower housing, a separation plate parallel to the front and rear walls dividing the blower housing into two chambers, a centrifugal blower wheel mounted on said drive shaft and positioned in one of said chambers, said separation plate having an opening for gas flow from the other of said chambers to the central area of said centrifugal blower wheel, and means extending beyond the blower housing wall strucrture to extend into said vent pipe for separating the gas at negative pressure flowing to the centrifugal blower wheel from the gas at positive pressure flowing therefrom when the power venter is installed in the vent pipe.

2. An in-line power venter as defined in claim 1 including a flow-regulating plate in the other of said chambers, means mounting said flow-regulating plate for movement along an axis extending generally normal to the plane of said gas flow opening, and means operable externally of the blower housing for adjusting the position of said flow-regulating plate relative to the opening in the separation plate.

3. An in-line power venter as defined in claim 2 wherein said externally operable means includes a nut fixed to the blower housing, a threaded member extended through said nut and fixed to said flow-regulating plate, and a knob on said threaded member, said threaded member having a limited length to prevent said flow-regulating plate completely closing said opening in the separation plate.

4. An in-line power venter as defined in claim 1 wherein the means on the separation plate extending beyond the wall structure of the blower housing comprises a pair of generally semicircular plate sections extending from the plane of the separator plate in opposite directions to each fit into one-half of the vent pipe and close off gas flow through the vent pipe except through the opening in the separation plate.

5. An in-line power venter comprising, a blower housing connectable into a vent pipe for a fuel burning device, a separator plate in said blower housing dividing the blower housing into first and second chambers, a blower wheel mounted in one chamber, an opening in said separator plate communicating the other chamber with the interior of the blower wheel, a flow-regulating plate in said other chamber, and means operable externally of the blower housing for adjustable positioning the flow-regulating plate relative to said opening including means for preventing movement of the flow-regulating plate to a position which would close said opening.

6. An in-line power venter as defined in claim 5 wherein said externally operable means includes a nut fixed to the blower housing, a threaded member extended through said nut and fixed to said flow-regulating plate, and a knob on said threaded member.

7. An in-line power venter insertable into a vent pipe for creating a draft for flow of combustion gas from a fuel burning appliance comprising a generally semicircular blower housing having an open top with front and rear walls and a connecting wall, a separator plate in spaced parallel relation with the front and rear walls dividing the blower housing into first and second chambers, a blower wheel in the first chamber, a motor fixed to the exterior of one of said front and rear walls and having a drive shaft connected to the blower wheel, an opening in the separator plate communicating with the interior of the blower wheel for flow of gas to the blower wheel from the second chamber, a pair of generally semicircular sections of said separator plate at a level above the front and rear walls extending generally at right angles from opposite edges of said separator plate and in opposite directions for insertion ito an opening cut in the vent pipe to block the first chamber from communication with the upstream side of the vent pipe and block the second chamber from the downstream side of the vent pipe, and upwardly-extending flanges on said front and rear walls for connection to the vent pipe.

8. In a power venter having a blower housing with spaced-apart front and rear walls, a motor mounted on one of said front and rear walls and having a drive shaft extending into said blower housing, means dividing the blower housing into two chambers, a centrifugal blower wheel mounted on said drive shaft and positioned in one of said chambers, and said means having an opening for gas flow from the other of said chambers to the central area of said centrifugal blower wheel, the improvement comprising a flow-regulating plate in the other of said chambers, means mounting said flow-regulating plate for movement along an axis extending generally normal to the plane of said gas flow opening, and means operable externally of the blower housing for adjusting the position of said flow-regulating plate relative to said opening.

9. In a power venter as defined in claim 8 wherein said externally operable means includes a nut fixed to the blower housing, a threaded member extended through said nut and fixed to said flow-regulating plate, and a knob on said threaded member, said threaded member having a limited length to prevent said flow-regulating plate completely closing said opening.

10. An in-line power venter insertable into a vent pipe for creating a draft for flow of combustion gas from a fuel burning appliance comprising, a housing having an open top with front and rear walls and a connecting wall, a separator plate in spaced parallel relation with the front and rear walls dividing the housing into first and second chambers, a gas-impelling device in the first chamber, a motor having a drive shaft connected to the gas-impelling device, an opening in the separator plate communicating with the gas-impelling device for flow of gas to the gas-impelling device from the second chamber, a pair of generally semicircular sections of said separator plate at a level above the front and rear walls extending generally at right angles from opposite edges of said separator plate and in opposite directions for insertion into an opening cut in the vent pipe to block the first chamber from communication with the upstream side of the vent pipe and block the second chamber from the downstream side of the vent pipe, and means on said front and rear walls for connection to the vent pipe.

* * * * *